US008519939B2

(12) United States Patent
Li et al.

(10) Patent No.: US 8,519,939 B2
(45) Date of Patent: Aug. 27, 2013

(54) LCD AND BACKLIGHT MODULE DRIVING DEVICE AND METHOD THEREOF

(75) Inventors: Yueh-Han Li, Hsinchu (TW); Po-Tang Hsu, Hsinchu (TW); Chien-Ming Ko, Hsinchu (TW); Ching-Chou Yu, Hsinchu (TW)

(73) Assignee: Au Optronics Corporation, Hsinchu (TW)

( * ) Notice: Subject to any disclaimer, the term of this patent is extended or adjusted under 35 U.S.C. 154(b) by 972 days.

(21) Appl. No.: 12/135,222

(22) Filed: Jun. 9, 2008

(65) Prior Publication Data

US 2009/0262064 A1 Oct. 22, 2009

(30) Foreign Application Priority Data

Apr. 22, 2008 (TW) ..... 97114704 A

(51) Int. Cl.
*G09G 3/36* (2006.01)

(52) U.S. Cl.
USPC ..... 345/102

(58) Field of Classification Search
USPC ..... 345/102
See application file for complete search history.

(56) References Cited

U.S. PATENT DOCUMENTS

| | | | | |
|---|---|---|---|---|
| 5,703,644 | A * | 12/1997 | Mori et al. | 348/363 |
| 6,346,994 | B1 * | 2/2002 | Inoue | 358/1.9 |
| 7,403,231 | B2 * | 7/2008 | Kawanishi | 348/364 |
| 2005/0007389 | A1 | 1/2005 | Kumamoto et al. | |
| 2007/0057900 | A1 | 3/2007 | Huang | |
| 2007/0091056 | A1 | 4/2007 | Okita et al. | |
| 2007/0176883 | A1 * | 8/2007 | Hsu et al. | 345/102 |
| 2007/0211014 | A1 | 9/2007 | Kim et al. | |
| 2007/0268237 | A1 * | 11/2007 | Shen | 345/102 |

* cited by examiner

*Primary Examiner* — Chanh Nguyen
*Assistant Examiner* — Tsegaye Seyoum
(74) *Attorney, Agent, or Firm* — Jianq Chyun IP Office

(57) ABSTRACT

An LCD and a backlight module driving device and a method thereof are provided. The method is adapted to drive at least one backlight unit in a backlight module. The backlight unit is used for supplying a surface light source to an $N^{th}$ area pixel of the LCD panel, where N is a positive integer. The method includes the following steps of first calculating a time of the $N^{th}$ area pixel under a stable state in a frame period and then providing a control signal to drive the backlight unit when the $N^{th}$ area pixel is under the stable state in the frame period.

25 Claims, 8 Drawing Sheets

LCD AND BACKLIGHT MODULE DRIVING DEVICE AND METHOD THEREOF

CROSS-REFERENCE TO RELATED APPLICATION

This application claims the priority benefit of Taiwan application serial no. 97114704, filed Apr. 22, 2008. The entirety of the above-mentioned patent application is hereby incorporated by reference herein and made a part of this specification.

BACKGROUND OF THE INVENTION

1. Field of the Invention

The present invention relates to a flat display technology and more particularly, to a liquid crystal display (LCD) and a backlight module driving device and method thereof.

2. Description of Related Art

In recent years, with great advancement in the fabricating technology of electrical-optical and semiconductor devices comes prosperous development in flat panel displays. Due to the advantageous features of LCDs such as high space utilization efficiency, low power consumption, free radiation, and low electrical field interference, LCDs have become the main stream on the market. An LCD generally includes an LCD panel and a backlight module. The LCD panel does not have a self-illuminating property. Therefore, the backlight module is disposed under the LCD panel so as to provide a surface light source required by the LCD panel to display images.

In the conventional technology, in order to increase color saturation of an LCD, those skilled in the art seek advancement in the LCD driving circuit and method. In addition, those skilled in the art use a backlight module with light emitting diode (LED) that has higher color purity to replace a backlight module that emits white light in the conventional technology. Although such method may effectively increase color saturation of an LCD, it also brings about many disadvantages. The following illustration explains the disadvantages of a conventional LED backlight module in connection with relevant drawings.

FIG. 1 illustrates a state diagram of a certain area pixel Pix_n of a conventional LCD panel and a timing diagram of a control signal BL_CS of an LED backlight module. It is obvious that from FIG. 1, the control signal BL_CS of the LED backlight module is constantly under operation mode so when the area pixel Pix_n of the LCD panel in a frame period FR (i.e. a time of a vertical synchronous signal V_SYNC) is under a transition state (i.e. a slash interlace area), the LED backlight module still continues to provide a surface light source to the LCD panel. That is, the control signal of the LCD panel is not related to the control signal of the LED backlight module, which results in motion blur of display images presented by the LCD.

Furthermore, the control signal BL_CS of the LED backlight module is generally a 600 Hz PWM signal. Thus, the transition frequency of the control signal BL_CS of the LED backlight module is higher than the frame rate of the LCD (generally 60 Hz). As a result, the electromagnetic interference (EMI) caused by the control signal BL_CS of the LED backlight module is too high and the overall EMI index of the LCD is greatly increased.

SUMMARY OF THE INVENTION

In light of the above, the present invention provides a backlight module driving device and method to effectively control the issue of an overly high EMI caused by the control signal of the conventional LED backlight module and to significantly improve the possibility of motion blur in the display images of an LCD that uses the LED backlight module.

The present invention provides a backlight module driving method adapted to drive at least one backlight unit in a backlight module. The backlight unit provides a surface light source to an $N^{th}$ area pixel of the LCD panel, where N is a positive integer. The backlight module driving method of the present invention includes the following steps of first calculating a total time of the $N^{th}$ area pixel under a stable state in a frame period so as to obtain a center position of the total time of the $N^{th}$ area pixel under the stable state in the frame period. Then, providing a control signal to drive the backlight unit according to the center position of the total time of the $N^{th}$ area pixel under the stable state in the frame period.

According to one embodiment of the present invention, the backlight module driving method of the present invention is further adapted to drive a plurality of sub backlight units in the backlight unit, wherein an $i^{th}$ sub backlight unit is used to provide a surface light source to an $i^{th}$ area pixel in the $N^{th}$ area pixel, where i is a positive integer. Therefore, the backlight module driving method of the present invention further includes the following steps of providing a plurality of sub control signals to respectively drive the sub backlight units according to the center position of the total time of the $N^{th}$ area pixel under the stable state in the frame period.

The present invention further provides a backlight module driving device adapted to drive at least one backlight unit in a backlight module. The backlight unit provides a surface light source to an $N^{th}$ area pixel of the LCD panel, where N is a positive integer. The backlight module driving device of the present invention includes a calculation unit and a driving unit. The calculation unit is used to calculate a total time of the $N^{th}$ area pixel under a stable state in a frame period so as to obtain a center position of the total time of the $N^{th}$ area pixel under the stable state in the frame period. The driving unit is coupled to the calculation unit and the backlight module for providing a control signal to drive the backlight unit according to the center position of the total time of the $N^{th}$ area pixel under the stable state in the frame period.

According to one embodiment of the present invention, the backlight unit includes a plurality of sub backlight units, wherein an $i^{th}$ sub backlight unit is used to provide a surface light source to an $i^{th}$ area pixel in the $N^{th}$ area pixel, where i is a positive integer.

According to one embodiment of the present invention, the driving unit provides a plurality of sub control signals to respectively drive the sub backlight units according to the center position of the total time of the $N^{th}$ area pixel under the stable state in the frame period.

The present invention further provides a backlight module driving method adapted to drive at least one backlight unit in a backlight module. The backlight unit provides a surface light source to an $N^{th}$ area pixel of the LCD panel, where N is a positive integer. The backlight module driving method of the present invention includes the following steps of first calculating a total time of the $N^{th}$ area pixel under a stable state in a frame period. Then, providing a control signal to drive the backlight unit when the $N^{th}$ area pixel is under the stable state in the frame period.

According to one embodiment of the present invention, a turn-on time of the control signal substantially does not extend into a transition state of the $N^{th}$ area pixel and an $(N+1)^{th}$ area pixel of the LCD panel.

The present invention further provides an LCD which comprises an LCD panel, a backlight module comprising at least one backlight unit, and the aforementioned backlight module driving device of the present invention.

In one embodiment of the present invention described above, the turn-on time of the control signal aligns with the center position of the total time of the $N^{th}$ area pixel under the stable state in the frame period. The turn-on time of the control signal substantially does not extend into a transition state of the $N^{th}$ area pixel and the $(N+1)^{th}$ area pixel of the LCD panel.

In one embodiment of the present invention described above, the control signal is a PWM signal.

In one embodiment of the present invention described above, the center positions of the turn-on times of the sub control signals align with the center position of the total time of the $N^{th}$ area pixel under the stable state in the frame period. The turn-on times of the sub control signals substantially does not extend into a transition state of the $N^{th}$ area pixel and the $(N+1)^{th}$ area pixel of the LCD panel.

In one embodiment of the present invention described above, the sub control signals have different turn-on times and each of the sub control signals is a PWM signal.

In one embodiment of the present invention described above, the backlight module is an LED backlight module.

The backlight module driving device and method of the present invention are designed with a transition state frequency of the control signal of the backlight module that is the same as a frame rate of the LCD so as to not only control the overly high EMI caused by the control signal of the LED backlight module but also ease the influence of the EMI index on the whole LCD.

In addition, the backlight module driving device and method of the present invention is mainly applied to an LED backlight module that has been designed with separate area control. Therefore, when a certain area pixel of the LCD panel is under a transition state in any frame period, the backlight module driving device and method of the present invention not only does not provide a surface light source to the certain area pixel but also tries not to provide a surface light source to pixels in areas close to the certain area pixel. Accordingly, effects of black frame insertion technology may be increased. Display images with motion blur in the LCD that uses the backlight module driving device and method of the present invention would almost never occur due to the liquid crystals under transition the state.

In order to make the aforementioned and other objects, features and advantages of the present invention more comprehensible, several embodiments accompanied with figures are described in detail below.

BRIEF DESCRIPTION OF THE DRAWINGS

The accompanying drawings are included to provide a further understanding of the invention, and are incorporated in and constitute a part of this specification. The drawings illustrate embodiments of the invention and, together with the description, serve to explain the principles of the invention.

DESCRIPTION OF EMBODIMENTS

The present invention may effectively prevent an overly high EMI caused by control signals of a conventional LED backlight module and significantly improve the possibility of motion blur in the display images of a conventional LCD.

Figure 1:
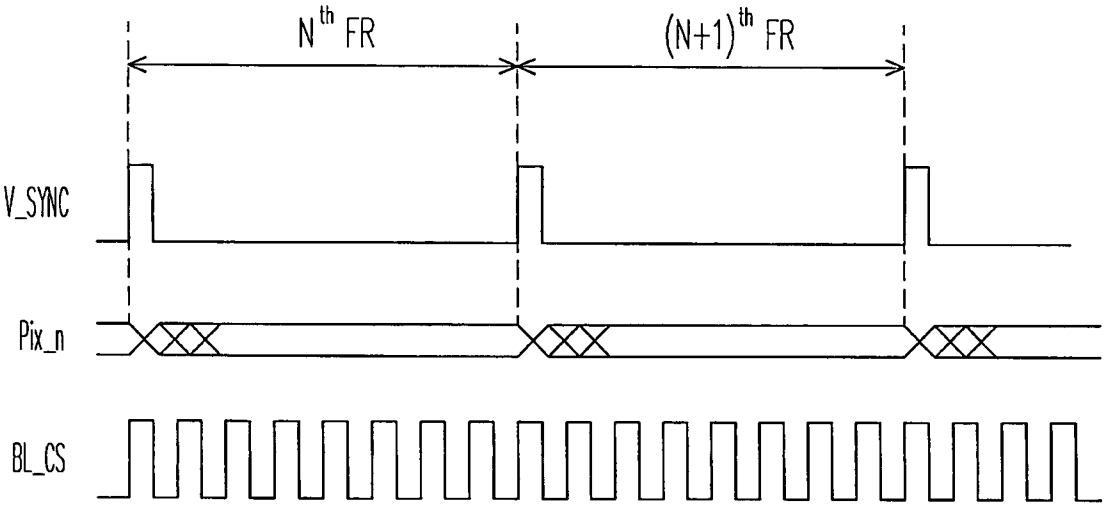
FIG. 1 (PRIOR ART)
FIG. 1 illustrates a state diagram of an area pixel of a conventional LCD panel and a timing diagram of a control signal of an LED backlight module.
Figure 2:
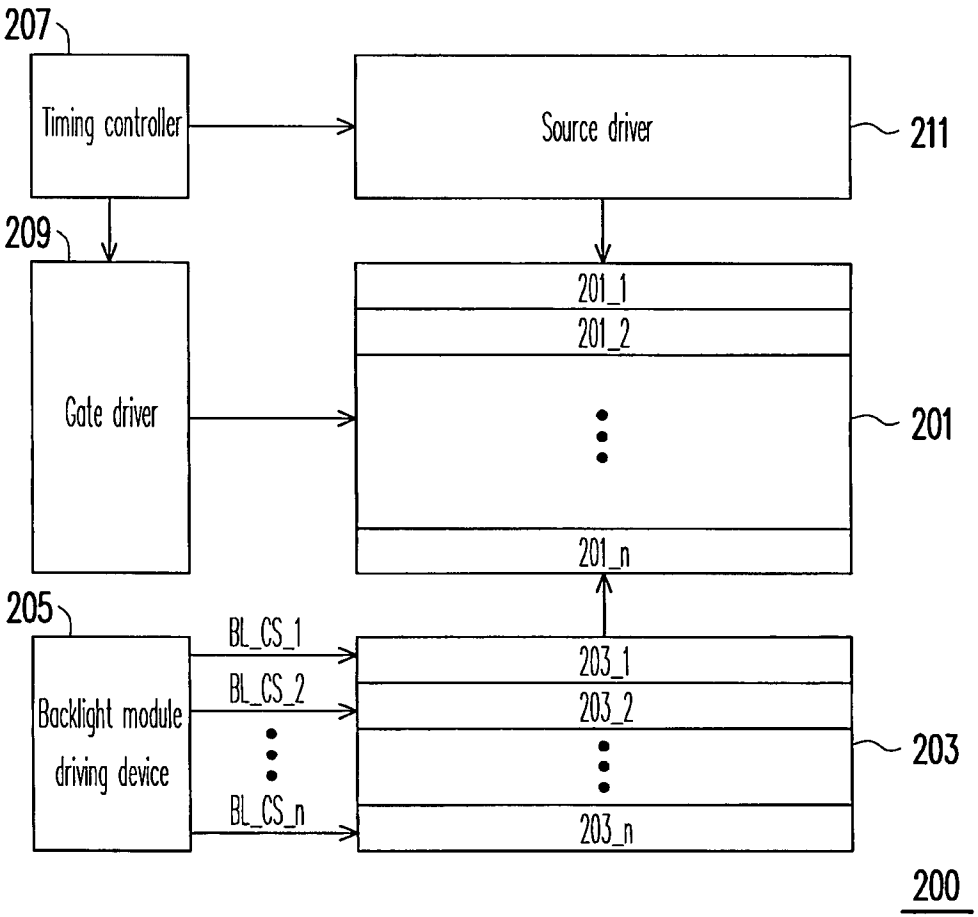
FIG. 2 is a system block diagram of an LCD according to an embodiment of the invention.

FIG. 2 is a system block diagram of an LCD according to an embodiment of the invention. Referring to FIG. 2, the LCD 200 comprises an LCD panel 201 used to display images, a backlight module 203 (the present embodiment uses an LED backlight module as an example), a backlight module driving device 205, a timing controller 207, a gate driver 209, and a source driver 211.

In the present embodiment, the LED backlight module 203 comprises a plurality of area backlight units 203_1~203_n used to provide a surface light source to corresponding pixels of the LCD panel 201 in sequence. To be specific, the backlight unit 203_1 mainly provides a surface light source to pixels in an area 201_1 of the LCD panel 201, the backlight unit 203_2 mainly provides a surface light source to pixels in an area 201_2 of the LCD panel 201, and so on, the backlight unit 203_n mainly provides a surface light source to pixels in an area 201_n of the LCD panel 201, where n is a positive integer.

Here, suppose the LED backlight module 203 comprises four area backlight units 203_1~203_4 (not limited herein) and the resolution of the LCD panel 201 is 1024×768, then the LCD panel 201 is correspondingly divided into four areas of pixels 201_1~201_4, each of which includes 192 scan lines.

The backlight module driving device 205 is coupled to the LED backlight module 203 to drive each area backlight unit 203_1~203_n of the LED backlight module 203. The gate driver 209 is controlled by the timing controller 207 to turn on each row of pixels in the LCD panel 201 one by one. The source driver 211 is also controlled by the timing controller 207 to provide a corresponding data voltage (or pixel voltage) to the rows of pixels in the LCD panel 201 turned on by the gate driver 209.

It should be noted that the control signals of a conventional LED backlight module not only cause overly high EMI but also cause the LCD to display images with motion blur to the user. Thus, the present invention uses the backlight module driving device 205 to solve the problems. The illustration below explains the backlight module driving device 205 in detail.

Figure 3:
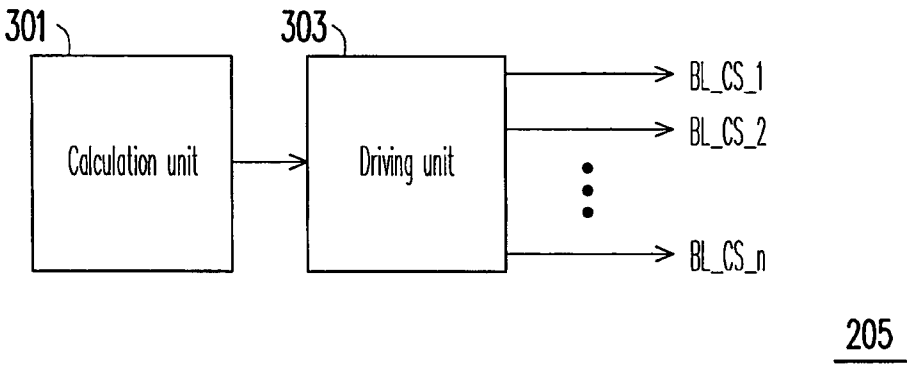
FIG. 3 is a block diagram of a backlight module driving device according to an embodiment of the invention.

FIG. 3 is a block diagram of a backlight module driving device according to an embodiment of the invention. Referring to both FIG. 2 and FIG. 3, the backlight module driving device 205 comprises a calculation unit 301 and a driving unit 303. The calculation unit 301 calculates a total time of the pixels in each area 201_1~201_n of the LCD panel 201 under a stable state in a frame period so as to obtain a center position of the total time of pixels in each area 201_1~201_n of the LCD panel under the stable state in a frame period.

The driving unit 303 is coupled to the calculation unit 301 and the LED backlight module 203 for providing control signals BL_CS_1~BL_CS_n to respectively drive each area backlight unit 203_1~203_n in the LED backlight module 203 according to the total time of pixels in each area 201_1~201_n of the LCD panel 201 under the stable state in a frame period.

To better illustrate the implementation principles of the present invention, suppose that the LED backlight module 203 comprises five area backlight units 203_1~203_5. The present invention does not limit the number to be this odd numbered value. Any other odd numbered values are acceptable. Therefore, the LCD panel 201 is correspondingly divided into five areas of pixels 201_1~201_5. The five area backlight units 203_1~203_5 respectively provide surface light sources to the five areas of pixels 201_1~201_5 of the LCD panel 201. Based on the above, FIG. 4 is a state diagram of pixels in the five areas 201_1~201_5 of the LCD panel 201 and a timing diagram of the five control signals BL_CS_1~BL_CS_5 of the LED backlight module 203 according to an embodiment of the invention.

Figure 4:
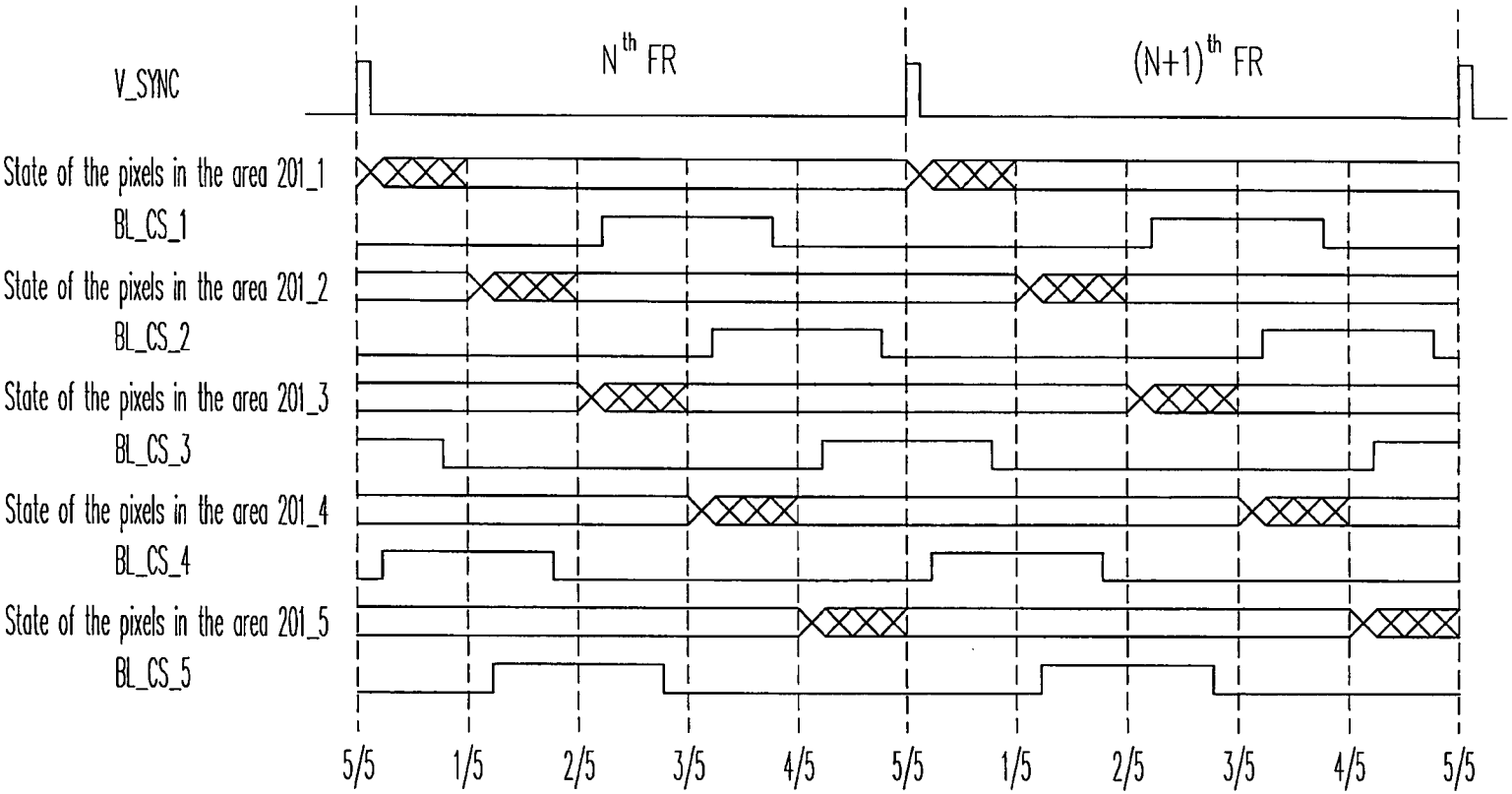
FIG. 4 is a state diagram of pixels in five areas of an LCD panel and a timing diagram of five control signals of an LED backlight module according to an embodiment of the invention.

Referring to both FIG. 2 and FIG. 4, clearly from the state of the pixels in the area 201_1 of the LCD panel 201, the total time when the pixels in the area 201_1 of the LCD panel 201 are under a transition state (i.e. slash interlace area) would occupy 1/5 of a frame period FR. Therefore, the total time when the pixels in the area 201_1 of the LCD panel 201 are under a stable state would occupy 4/5 of a frame period FR. Accordingly, the calculation unit 301 may calculate a total time of the pixels in the area 201_1 of the LCD panel 201 under a stable state (i.e. non slash interlace area) in a frame period FR so as to find that the center position of the total time of pixels in the area 201_1 of the LCD panel 201 under the stable state in a frame period FR falls on 3/5 of a frame period FR.

In addition, clearly from the state of the pixels in the area 201_2 of the LCD panel 201, the total time when the pixels in the area 201_2 of the LCD panel 201 are under a transition state would still occupy 1/5 of a frame period FR. Therefore, the total time when the pixels in the area 201_2 of the LCD panel 201 are under a stable state would occupy the remaining 4/5 of a frame period FR. Accordingly, the calculation unit 301 may calculate a total time of the pixels in the area 201_2 of the LCD panel 201 under a stable state in a frame period FR so as to find that the center position of the total time of pixels in the area 201_2 of the LCD panel 201 under the stable state in a frame period FR falls on 4/5 of a frame period FR.

In addition, clearly from the state of the pixels in the area $201_{13}$ 3 of the LCD panel 201, the total time when the pixels in the area 201_3 of the LCD panel 201 are under a transition state would still occupy 1/5 of a frame period FR. Therefore, the total time when the pixels in the area 201_3 of the LCD panel 201 are under a stable state would occupy the remaining 4/5 of a frame period FR. Accordingly, the calculation unit 301 may calculate a total time of the pixels in the area 201_3 of the LCD panel 201 under a stable state in a frame period FR so as to find that the center position of the total time of pixels in the area 201_3 of the LCD panel 201 under the stable state in a frame period FR falls on 5/5 of a frame period FR.

In addition, clearly from the state of the pixels in the area 201_4 of the LCD panel 201, the total time when the pixels in the area 201_4 of the LCD panel 201 are under a transition state would still occupy 1/5 of a frame period FR. Therefore, the total time when the pixels in the area 201_4 of the LCD panel 201 are under a stable state would still occupy 4/5 of a frame period FR. Accordingly, the calculation unit 301 may calculate a total time of the pixels in the area 201_4 of the LCD panel 201 under a stable state in a frame period FR so as to find that the center position of the total time of pixels in the area 201_4 of the LCD panel 201 under the stable state in a frame period FR falls on 1/5 of a frame period FR.

Finally, clearly from the state of the pixels in the area 201_5 of the LCD panel 201, the total time when the pixels in the area 201_5 of the LCD panel 201 are under a transition state would still occupy 1/5 of a frame period FR. Therefore, the total time when the pixels in the area 201_5 of the LCD panel 201 are under a stable state would still occupy the remaining 4/5 of a frame period FR. Accordingly, the calculation unit 301 may calculate a total time of the pixels in the area 201_5 of the LCD panel 201 under a stable state in a frame period FR so as to find that the center position of the total time of pixels in the area 201_5 of the LCD panel 201 under the stable state in a frame period FR falls on 2/5 of a frame period FR.

Based on the above, the calculation unit 301 has calculated the center positions of the total time of pixels in the areas 201_1~201_5 of the LCD panel 201 under a stable state in a frame period FR (i.e. respectively falling on 3/5, 4/5, 5/5, 1/5, and 2/5 of the frame period FR). Accordingly, the driving unit 303 may provide control signals BL_CS_1~BL_CS_5 to respectively drive each area backlight units 203_1~203_5 in the LED backlight module 203. The center positions of the turn-on times of the control signals BL_CS_1~BL_CS_5 respectively align with the center positions of the total time of the pixels in the areas 201_1~201_5 of the LCD panel 201 under the stable state in a frame period FR. Each of the control signals BL_CS_1~BL_CS_5 is a PWM signal with a same turn-on time.

For example, the center position of the turn-on time of the control signal BL_CS_1 aligns with the center position of the total time of the pixels in the area 201_1 of the LCD panel 201 under the stable state in a frame period FR; the center position of the turn-on time of the control signal BL_CS_2 aligns with the center position of the total time of the pixels in the area 201_2 of the LCD panel 201 under the stable state in a frame period FR; and so on, the center position of the turn-on time of the control signal BL_CS_5 aligns with the center position of the total time of the pixels in the area 201_5 of the LCD panel 201 under the stable state in a frame period FR.

Continuously, referring to FIG. 4, it is apparent from FIG. 4, the pixels in each of the areas 201_1~201_5 of the LCD panel 201 are under the transition state so the corresponding backlight units 203_1~203_5 do not provide any surface light source, which not only achieves the technical means of black frame insertion but also reduces occurrences of motion blur in the images displayed to the user by the LCD 200 of the present embodiment.

To further increase the technical effects of black frame insertion, the turn-on time of the control signal BL_CS_1 provided by the driving unit 303 of the present embodiment should avoid being extended into a transition state of the pixels in the areas 201_1 and 201_2 of the LCD panel 201. Similarly, the turn-on time of the control signal BL_CS_2 provided by the driving unit 303 of the present embodiment should avoid being extended into a transition state of the pixels in the areas 201_2 and 201_3 of the LCD panel 201.

The turn-on time of the control signal BL_CS_3 provided by the driving unit 303 of the present embodiment should also avoid being extended into a transition state of the pixels in the areas 201_3 and 201_4 of the LCD panel 201. The turn-on time of the control signal BL_CS_4 provided by the driving unit 303 of the present embodiment should avoid being extended into a transition state of the pixels in the areas 201_4 and 201_5 of the LCD panel 201. The LCD panel 201 only has pixels in five areas 201_1~201_5 so the turn-on time of the control signal BL_CS_5 provided by the driving unit 303 of the present embodiment only needs to avoid being extended into a transition state of the pixels in the areas 201_5 of the LCD panel 201.

Since the pixels in each of the areas 201_1~201_5 of the LCD panel 201 under a transition state are not affected by their corresponding backlight units and neighboring backlight units. Therefore, the LCD 200 of the present invention is not likely to display images with motion blur to the user. Furthermore, any one of the control signals BL_CS_1~BL_CS_5 provided by the driving unit 303 has a transition state frequency that is the same as the frame rate of the LCD 200. Thus, the resulted EMI will not be too high. Accordingly, the EMI index of the whole LCD 200 influenced by the control signals BL_CS_1~BL_CS_5 of the LED backlight module 203 can be controlled.

From the above illustrated embodiment, the backlight module driving device of the present invention provides control signals to respectively drive each backlight unit in the LED backlight module according to the center position of the total time of the pixels in each of the areas of the LCD panel under the stable state in a frame period, which is a preferred embodiment but not to be limited herein by the scope of the present invention.

In another embodiment of the present invention, the backlight module driving device of the present invention provides control signals to respectively drive each backlight unit in the LED backlight module only when the pixels in each of the areas of the LCD panel are under the stable state in a frame period (for example, slightly shifting the center position in the above embodiment). However, the turn-on time of the control signal should in fact avoid being extended into the transition state of the pixels, which falls in the scope of the present invention.

Furthermore, the above embodiment gives an example of dividing the LCD panel 201 into odd-numbered areas (e.g. five). However, the scope of the present invention is not limited herein. An example of dividing the LCD panel 201 into even-numbered areas is given below.

Suppose the LED backlight module 203 has four backlight units 203_1~203_4. The number is not limited to be this even-numbered value and may be any other even-numbered values. Therefore, the LCD panel 201 is correspondingly divided into four areas of pixels 201_1~201_4. The four area backlight units 203_1~203_4 in the LED backlight module 203 respectively provide surface light sources to the four areas of pixels 201_1~201_4 of the LCD panel 201.

Figure 5:
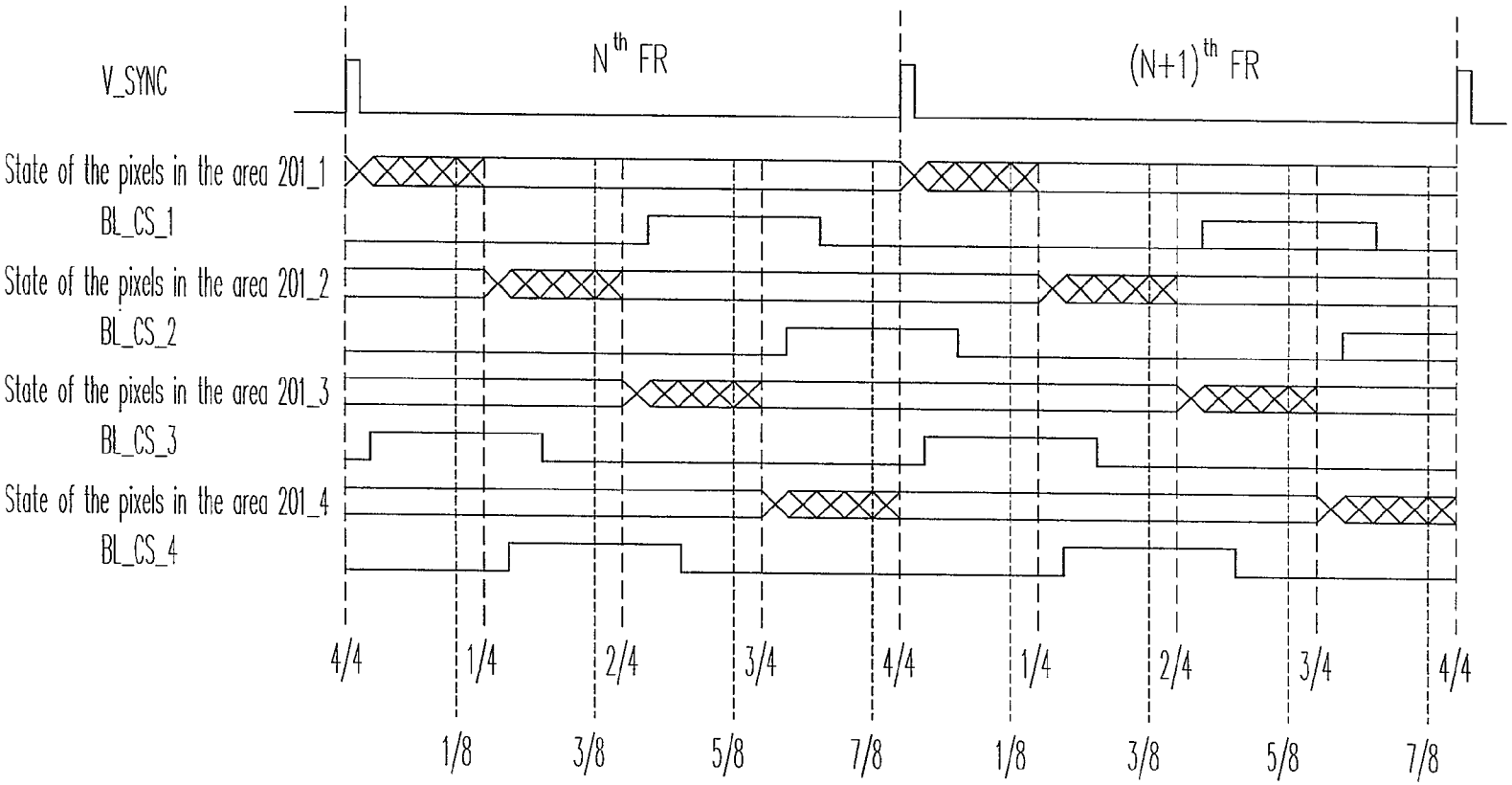
FIG. 5 is a state diagram of pixels in four areas of an LCD panel and a timing diagram of four control signals of an LED backlight module according to an embodiment of the invention.

Based on the above, FIG. 5 is a state diagram of pixels in the four areas 201_1~201_4 of the LCD panel 201 and a timing diagram of the four control signals BL_CS_1~BL_CS_4 of the LED backlight module 203 according to another embodiment of the invention. Referring to FIG. 2, FIG. 3, and FIG. 5 together, clearly from the state of the pixels in the area 201_1 of the LCD panel 201, the total time when the pixels in the area 201_1 of the LCD panel 201 are under a transition state (i.e. slash interlace area) would occupy 1/4 of a frame period FR. Therefore, the total time when the pixels in the area 201_1 of the LCD panel 201 are under a stable state would occupy the remaining 3/4 of a frame period FR. Accordingly, the calculation unit 301 may calculate a total time of the pixels in the area 201_1 of the LCD panel 201 under a stable state (i.e. non slash interlace area) in a frame period FR so as to find that the center position of the total time of the pixels in the area 201_1 of the LCD panel 201 under the stable state in a frame period FR falls on 5/8 of a frame period FR.

Clearly from the state of the pixels in the area 201_2 of the LCD panel 201, the total time when the pixels in the area 201_2 of the LCD panel 201 are under a transition state would still occupy 1/4 of a frame period FR. Therefore, the total time when the pixels in the area 201_2 of the LCD panel 201 are under a stable state would still occupy the remaining 3/4 of a frame period FR. Accordingly, the calculation unit 301 may calculate a total time of the pixels in the area 201_2 of the LCD panel 201 under a stable state in a frame period FR so as to find that the center position of the total time of pixels in the area 201_2 of the LCD panel 201 under the stable state in a frame period FR falls on 7/8 of a frame period FR.

In addition, clearly from the state of the pixels in the area 201_3 of the LCD panel 201, the total time when the pixels in the area 201_3 of the LCD panel 201 are under a transition state would still occupy 1/4 of a frame period FR. Therefore, the total time when the pixels in the area 201_3 of the LCD panel 201 are under a stable state would still occupy the remaining 3/4 of a frame period FR. Accordingly, the calculation unit 301 may calculate a total time of the pixels in the area 201_3 of the LCD panel 201 under a stable state in a frame period FR so as to find that the center position of the total time of pixels in the area 201_3 of the LCD panel 201 under the stable state in a frame period FR falls on 1/8 of a frame period FR.

Finally, clearly from the state of the pixels in the area 201_4 of the LCD panel 201, the total time when the pixels in the area 201_4 of the LCD panel 201 are under a transition state would still occupy 1/4 of a frame period FR. Therefore, the total time when the pixels in the area 201_4 of the LCD panel 201 are under a stable state would still occupy the remaining 3/4 of a frame period FR. Accordingly, the calculation unit 301 may calculate a total time of the pixels in the area 201_4 of the LCD panel 201 under a stable state in a frame period FR so as to find that the center position of the total time of pixels in the area 201_2 of the LCD panel 201 under the stable state in a frame period FR falls on 3/8 of a frame period FR.

Based on the above, the calculation unit 301 has calculated the center positions of the total time of the pixels in the areas 201_1~201_4 of the LCD panel 201 under a stable state in a frame period FR (i.e. respectively falling on 5/8, 7/8, 1/8, and 3/8 of the frame period FR). Accordingly, the driving unit 303 may provide control signals BL_CS_1~BL_CS_4 to respectively drive each of the area backlight units 203_1~203_4 in the LED backlight module 203. The center positions of the turn-on times of the control signals BL_CS_1~BL_CS_4 respectively align with the center positions of the total time of the pixels in the areas 201_1~201_4 of the LCD panel 201 under a stable state in a frame period FR. Each of the control signals BL_CS_~BL_CS_4 is a PWM signal with a same turn-on time.

For example, the center position of the turn-on time of the control signal BL_CS_1 aligns with the center position of the total time of the pixels in the area 201_1 of the LCD panel 201 under a stable state in a frame period FR; the center position of the turn-on time of the control signal BL_CS_2 aligns with the center position of the total time of the pixels in the area 201_2 of the LCD panel 201 under a stable state in a frame period FR; similarly, the center position of the turn-on time of the control signal BL_CS_4 aligns with the center position of the total time of the pixels in the area 201_4 of the LCD panel 201 under the stable state in a frame period FR.

Continuously, referring to FIG. 5, it is apparent from FIG. 5, the pixels in each of the areas 201_1~201_4 of the LCD panel 201 are under a transition state so the corresponding backlight units 203_1~203_4 do not provide any surface light source, which not only achieves the technical means of black insertion but also reduces occurrences of motion blur in the images displayed to the user by the LCD 200 of the present embodiment.

To further increase the technical effects of black insertion, the turn-on time of the control signal BL_CS_1 provided by the driving unit 303 of the present embodiment should avoid being extended into a transition state of the pixels in the areas 201_1 and 201_2 of the LCD panel 201. Similarly, the turn-on time of the control signal BL_CS_2 provided by the driving unit 303 of the present embodiment should avoid being extended into a transition state of the pixels in the areas 201_2 and 201_3 of the LCD panel 201.

In addition, the turn-on time of the control signal BL_CS_3 provided by the driving unit 303 of the present embodiment should avoid being extended into a transition state of the pixels in the areas 201_3 and 201_4 of the LCD panel 201. The LCD panel 201 only has pixels in the four areas 201_1~201_4 so the turn-on time of the control signal BL_CS_4 provided by the driving unit 303 of the present embodiment only needs to avoid being extended into a transition state of the pixels in the areas 201_4 of the LCD panel 201.

Since the pixels in each of the areas 201_1~201_5 of the LCD panel 201 under a transition state are not affected by their corresponding backlight units and neighboring backlight units. Therefore, the LCD 200 of the present invention is not likely to display images with motion blur to the user. Furthermore, any one of the control signals BL_CS_1~BL_CS_4 provided by the driving unit 303 has a transition state frequency that is the same as the frame rate of the LCD 200. Thus, the resulted EMI will not be too high. Accordingly, the EMI index of the whole LCD 200 influenced by the control signals BL_CS_1~BL_CS_4 of the LED backlight module 203 can be controlled.

Figure 6:
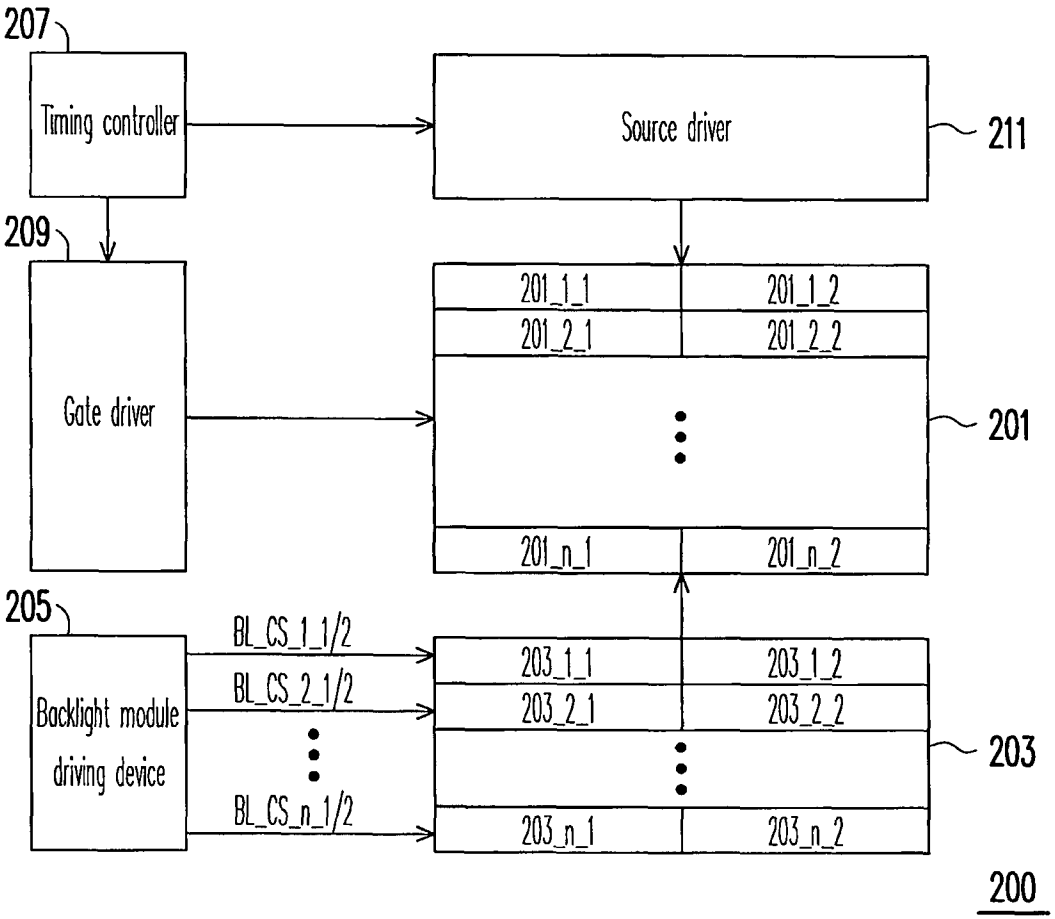
FIG. 6 is a system block diagram of an LCD according to another embodiment of the invention.

However, the scope of the present invention is not limited to the above embodiment. In another embodiment of the present invention, each of the area backlight units 203_1~203_n in the LED backlight module 203 has a plurality of sub backlight units (two, for example, as shown in FIG. 6, which may be modified according to design requirement and is not limited herein). In other words, the backlight unit 203_1 has two sub backlight units 203_1_1 and 203_1_2, the backlight unit 203_2 has two sub backlight units 203_2_1 and 203_2_2, . . . , and the backlight unit 203_n has two sub backlight units 203_n_1 and 203_n_2.

Accordingly, the sub backlight unit 203_1_1 mainly provides a surface light source to the pixels in the area 201_1_1 of the LCD panel 201, the sub backlight unit 203_1_2 mainly provides a surface light source to the pixels in the area 201_1_2 of the LCD panel 201, and so on, the sub backlight unit 203_n_1 mainly provides a surface light source to the pixels in the area 201_n_1 of the LCD panel 201, and the sub backlight unit 203_n_2 mainly provides a surface light source to the pixels in the area 201_n_2 of the LCD panel 201.

In the present embodiment, each of the area backlight units 203_1~203_n has two sub backlight units so the backlight module driving device 205 of the present invention has to be capable of driving each sub backlight unit in the area backlight units 203_1~203_n. Thus, the driving unit 303 of the present embodiment provides a plurality of sub control signals BL_CS_1_1/2~BL_CS_n_1/2 to respectively drive each of the sub backlight units 203_1_1~203_n_2 in the LED backlight module 203 according to the center position of the total time of the pixels in the areas 201_1_1~201_n_2 of the LCD panel 201 under a stable state in a frame period FR. This achieves the same technical effects as the abovementioned embodiment.

It should be noted that the center positions of the turn-on times of sub control signals respectively received by sub backlight units of a same area still align with the center position of the total time of the pixels in the corresponding area under the stable state in a frame period FR. For example, the center positions of the turn-on times of the sub control signals BL_CS_1_1/2 respectively received by the sub backlight units 203_1_1 and 203_1_2 align with the center position of the total time of the pixels in the areas 201_1_1 and 201_1_2 of the LCD panel 201 under the stable state in a frame period.

The center positions of the turn-on times of the sub control signals BL_CS_2_1/2 respectively received by the sub backlight units 203_2_1 and 203_2_2 align with the center position of the total time of the pixels in the areas 201_2_1 and 201_2_2 of the LCD panel 201 under the stable state in a frame period. It follows that the center positions of the turn-on times of the sub control signals BL_CS_n_1/2 respectively received by the sub backlight units 203_n_1 and 203_n_2 align with the center position of the total time of the pixels in the areas 201_n_1 and 201_n_2 of the LCD panel 201 under the stable state in a frame period.

In addition, the turn-on times of the sub control signals BL_CS_1_1/2 respectively received by the sub backlight units 203_1_1 and 203_1_2 should avoid being extended into a transition state of the areas 201_1 and 201_2 of the LCD panel 201. However, the turn-on times of the sub control signals BL_CS_1_1/2 respectively received by the sub backlight units 203_1_1 and 203_1_2 may be different.

Similarly, the turn-on times of the sub control signals BL_CS_2_1/2 respectively received by the sub backlight units 203_2_1 and 203_2_2 should avoid being extended into a transition state of the pixels in the areas 201_2 and 201_3 of the LCD panel 201. However, the turn-on times of the sub control signals BL_CS_2_1/2 respectively received by the sub backlight units 203_2_1 and 203_2_2 may be different. It follows that the turn-on times of the sub control signals BL_CS_n_1/2 respectively received by the sub backlight units 203_n_1 and 203_n_2 should avoid being extended into a transition state of the pixels in the areas 201_n of the LCD panel 201. However, the turn-on times of the sub control signals BL_CS_n_1/2 respectively received by the sub backlight units 203_n_1 and 203_n_2 may be different.

Accordingly, the backlight module driving device of the present invention provides control signals having a transition state frequency which is the same as the frame rate of the LCD so as to not only contain the overly high EMI caused by the control signals of the LED backlight module but also ease the influence of the EMI index on the whole LCD.

In addition, the backlight module driving device of the present invention is mainly applied to an LED backlight module that has been designed with separate area control. Therefore, when a certain area of pixels of the LCD panel is under a transition state in any frame period, the backlight module driving device of the present invention not only does not provide a surface light source to the certain area of pixels but also tries not to provide a surface light source to pixels in areas close to the certain area of pixels. Accordingly, effects of black insertion technology may be increased and display images with motion blur in the LCD would almost never occur.

Figure 7:
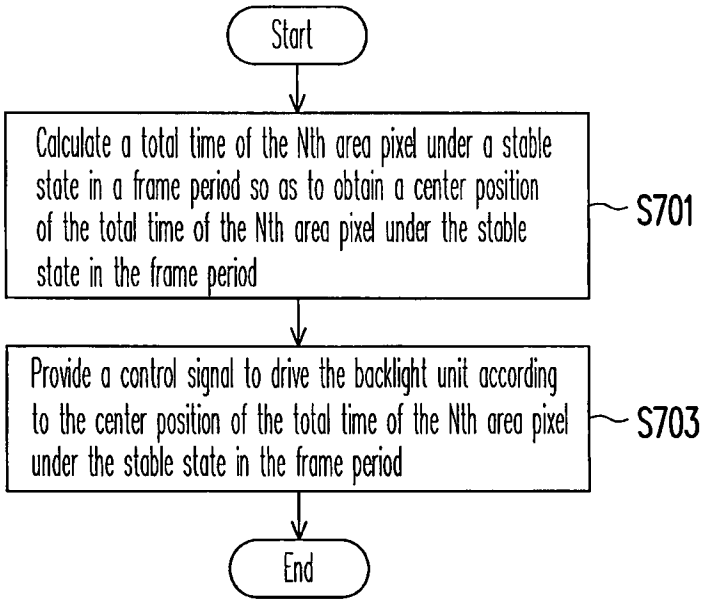
FIG. 7 is a flow chart of a backlight module driving method according to an embodiment of the invention.

Furthermore, according to the content disclosed in the above embodiment, two backlight module driving methods are summarized below for those skilled in the art. FIG. 7 is a flow chart of a backlight module driving method according to an embodiment of the invention. Referring to FIG. 7, the backlight module driving method of the present embodiment is adapted to drive at least one backlight unit in a backlight module and the backlight unit provides a surface light source to an $N^{th}$ area pixel of an LCD panel, where N is a positive integer and the backlight module is an LED backlight module.

The backlight module driving method comprises the following steps. First, as shown in step S701, calculate a total time of the $N^{th}$ area pixel under a stable state in a frame period so as to obtain a center position of the total time of the $N^{th}$ area pixel under the stable state in the frame period. Then, as shown in step S703, provide a control signal to drive the backlight unit according to the center position of the total time of the $N^{th}$ area pixel under the stable state in the frame period.

In the present embodiment, a center position of a turn-on time of the control signal aligns with the center position of the total time of the $N^{th}$ area pixel under the stable state in the frame period. The turn-on time of the control signal should avoid being extended into a transition state of the $N^{th}$ area pixel and the $(N+1)^{th}$ area pixel of the LCD panel. The control signal is a PWM signal.

In addition, the backlight module driving method of the present invention is more adapted to drive a plurality of sub backlight units in the backlight unit, wherein an $i^{th}$ sub backlight unit is used to provide a surface light source to an $i^{th}$ area pixel in the $N^{th}$ area of pixels. Therefore, the backlight module driving method of the present invention may provide a plurality of sub control signals to respectively drive the plurality of sub backlight units according to the center position of the total time of the $N^{th}$ area of pixels under the stable state in the frame period.

In the present embodiment, the center positions of the turn-on times of the sub control signals align with the center position of the total time of the $N^{th}$ area pixel under the stable state in the frame period, and the turn-on times of the sub control signals substantially should avoid being extended into a transition state of the $N^{th}$ area pixel and the $(N+1)^{th}$ area pixel of the LCD panel. The sub control signals have different turn-on times and each of the sub control signals is a PWM signal.

Figure 8:
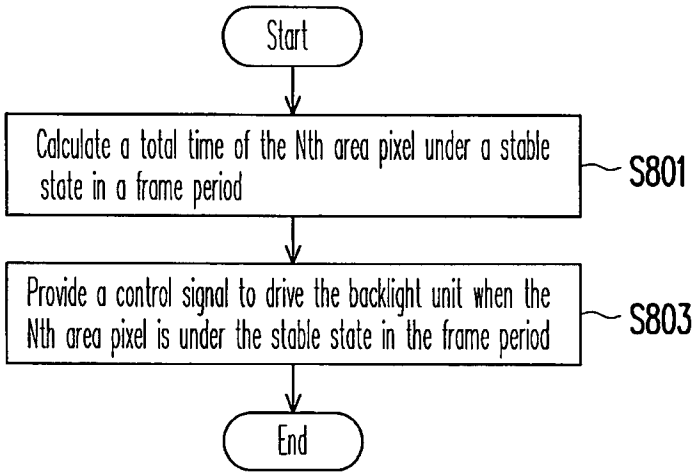
FIG. 8 is a flow chart of a backlight module driving method according to another embodiment of the invention.

FIG. 8 is a flow chart of a backlight module driving method according to another embodiment of the invention. Referring to FIG. 8, the backlight module driving method of the present embodiment is adapted to drive at least one backlight unit in a backlight module and the backlight unit provides a surface light source to an $N^{th}$ area pixel of an LCD panel, where N is a positive integer and the backlight module is an LED backlight module.

The backlight module driving method comprises the following steps. First, as shown in step S801, calculate a total time of the $N^{th}$ area pixel under a stable state in a frame period. Then, as shown in step S803, provide a control signal to drive the backlight unit when the $N^{th}$ area pixel is under the stable state in the frame period. In the present embodiment, the turn-on time of the control signal should avoid being extended into a transition state of the $N^{th}$ area pixel and the $(N+1)^{th}$ area pixel of the LCD panel.

In summary, the backlight module driving device and method of the present invention are designed with a transition state frequency of the control signals of the backlight module that is the same as a frame rate of the LCD so as to not only control the overly high EMI caused by the control signals of the LED backlight module but also ease the influence of the EMI index on the whole LCD.

In addition, the backlight module driving device and method of the present invention is mainly applied to an LED backlight module that has been designed with separate area control. Therefore, when a certain area pixel of the LCD panel is under a transition state in any frame period, the backlight module driving device and method of the present invention not only does not provide a surface light source to the certain area pixel but also tries not to provide a surface light source to pixels in areas close to the certain area pixel. Accordingly, effects of black frame insertion technology may be increased. Display images with motion blur in the LCD that uses the backlight module driving device and method of the present invention would almost never occur due to the liquid crystals under transition state.

Although the present invention has been disclosed by the above embodiments, they are not intended to limit the present invention. Anybody skilled in the art may make some modifications and alterations without departing from the spirit and scope of the present invention. Therefore, the protection range of the present invention falls in the appended claims.

What is claimed is:

1. A backlight module driving method, adapted to drive at least one backlight unit in a backlight module, wherein the backlight unit provides a surface light source to an $N^{th}$ area pixel of a liquid crystal display (LCD) panel of an LCD, where N is a positive integer, the backlight module driving method comprising:

calculating a total time of the $N^{th}$ area pixel under a stable state in a frame period; and providing a control signal to drive the backlight unit within the total time of the $N^{th}$ area pixel under the stable state in the frame period, so as to make the backlight unit provide the surface light source to the $N^{th}$ area pixel, wherein a center position of a turn-on time of the control signal aligns with a center position of the total time of the $N^{th}$ area pixel under the stable state in the frame period, and the turn-on time of the control signal substantially does not extend into a transition state of the $N^{th}$ area pixel and an $(N+1)^{th}$ area pixel of the LCD panel, wherein the $(N+1)^{th}$ area pixel is close to the $N^{th}$ area pixel.

2. The backlight module driving method according to claim 1, wherein the backlight unit comprises a plurality of sub backlight units, and the backlight module driving method further comprising:

providing a plurality of sub control signals to respectively drive the sub backlight units according to the center position of the total time of the $N^{th}$ area pixel under the stable state in the frame period, wherein an $i^{th}$ sub backlight unit is used to provide a surface light source to an $i^{th}$ area pixel in the $N^{th}$ area pixel, where i is a positive integer.

3. The backlight module driving method according to claim 2, wherein center positions of turn-on times of the sub control signals align with the center position of the total time of the $N^{th}$ area pixel under the stable state in the frame period, and the turn-on times of the sub control signals substantially do not extend into a transition state of the $N^{th}$ area pixel and an $(N+1)^{th}$ area pixel of the LCD panel.

4. The backlight module driving method according to claim 2, wherein the sub control signals have different turn-on times.

5. The backlight module driving method according to claim 1, wherein a frequency of the control signal is the same as a frame rate of the LCD.

6. The backlight module driving method according to claim 1, wherein a turn-on time of the control signal is shorter than the total time of the $N^{th}$ area pixel under the stable state in the frame period.

7. The backlight module driving method according to claim 1, wherein a time period between an ending time point of the $N^{th}$ area pixel under a transition state in a current frame period and a turn-on time point of the control signal is equal to a time period between a turn-off time point of the control signal and an starting time point of the $N^{th}$ area pixel under a transition state in a next frame period.

8. A backlight module driving device, adapted to drive at least one backlight unit in a backlight module, wherein the backlight unit provides a surface light source to an $N^{th}$ area pixel of an LCD panel of an LCD, where N is a positive integer, the backlight module driving device comprising:

a calculation unit, used for calculating a total time of the $N^{th}$ area pixel under a stable state in a frame period; and a driving unit, coupled to the calculation unit and the backlight module, for providing a control signal to drive the backlight unit within the total time of the $N^{th}$ area pixel under the stable state in the frame period, so as to make the backlight unit provide the surface light source to the $N^{th}$ area pixel, wherein a center position of a turn-on time of the control signal aligns with a center position of the total time of the $N^{th}$ area pixel under the stable state in the frame period, and the turn-on time of the control signal substantially does not extend into a transition state of the $N^{th}$ area pixel and an $(N+1)^{th}$ area pixel of the LCD panel, wherein the $(N+1)^{th}$ area pixel is close to the $N^{th}$ area pixel.

9. The backlight module driving device according to claim 8, wherein the backlight unit comprises a plurality of sub backlight units, and an $i^{th}$ sub backlight unit is used to provide a surface light source to an $i^{th}$ area pixel in the $N^{th}$ area pixel, where i is a positive integer.

10. The backlight module driving device according to claim 9, wherein the driving unit further provides a plurality of sub control signals to respectively drive the sub backlight units according to the center position of the total time of the $N^{th}$ area pixel under the stable state in the frame period.

11. The backlight module driving device according to claim 10, wherein center positions of turn-on times of the sub control signals align with the center position of the total time of the $N^{th}$ area pixel under the stable state in the frame period, and the turn-on times of the sub control signals substantially do not extend into a transition state of the $N^{th}$ area pixel and an $(N+1)^{th}$ area pixel of the LCD panel.

12. The backlight module driving device according to claim 11, wherein the sub control signals have different turn-on times.

13. The backlight module driving device according to claim 8, wherein a frequency of the control signal is the same as a frame rate of the LCD.

14. The backlight module driving device according to claim 8, wherein a turn-on time of the control signal is shorter than the total time of the $N^{th}$ area pixel under the stable state in the frame period.

15. The backlight module driving device according to claim 8, wherein a time period between an ending time point of the $N^{th}$ area pixel under a transition state in a current frame period and a turn-on time point of the control signal is equal to a time period between a turn-off time point of the control signal and an starting time point of the $N^{th}$ area pixel under a transition state in a next frame period.

16. An LCD, comprising:

an LCD panel;

a backlight module, comprising at least one backlight unit which provides a surface light source to an $N^{th}$ area pixel of the LCD panel, where N is a positive integer; and a backlight module driving device, coupled to the backlight module, for calculating a total time of the $N^{th}$ area pixel under a stable state in a frame period, and thus providing a control signal to drive the backlight unit within the total time of the $N^{th}$ area pixel under the stable state in the frame period, so as to make the backlight unit provide the surface light source to the $N^{th}$ area pixel, wherein a center position of a turn-on time of the control signal aligns with a center position of the total time of the $N^{th}$ area pixel under the stable state in the frame period, and the turn on time of the control signal substantially does not extend into a transition state of the $N^{th}$ area pixel and an $(N+1)^{th}$ area pixel of the LCD panel, wherein the $(N+1)^{th}$ area pixel is close to the $N^{th}$ area pixel.

17. The LCD according to claim 16, wherein the backlight module driving device comprises:

a calculation unit, used to calculate the total time of the $N^{th}$ area pixel under the stable state in the frame period; and a driving unit, coupled to the calculation unit and the backlight module, for providing the control signal to drive the backlight unit within the total time of the $N^{th}$ area pixel under the stable state in the frame period.

18. The LCD according to claim 17, wherein the backlight unit comprises a plurality of sub backlight units and an $i^{th}$ sub backlight unit is used to provide a surface light source to an $i^{th}$ area pixel in the $N^{th}$ area pixel, where i is a positive integer.

19. The LCD according to claim 18, wherein the driving unit further provides a plurality of sub control signals to respectively drive the sub backlight units according to the center position of the total time of the $N^{th}$ area pixel under the stable state in the frame period.

20. The LCD according to claim 19, wherein center positions of turn-on times of the sub control signals align with the center position of the total time of the $N^{th}$ area pixel under the stable state in the frame period, and the turn-on times of the sub control signals substantially do not extend into a transition state of the $N^{th}$ area pixel and an $(N+1)^{th}$ area pixel of the LCD panel.

21. The LCD according to claim 20, wherein the sub control signals have different turn-on times.

22. The LCD according to claim 16, wherein a frequency of the control signal is the same as a frame rate of the LCD.

23. The LCD according to claim 16, wherein a turn-on time of the control signal is shorter than the total time of the $N^{th}$ area pixel under the stable state in the frame period.

24. The LCD according to claim 16, wherein a time period between an ending time point of the $N^{th}$ area pixel under a transition state in a current frame period and a turn-on time point of the control signal is equal to a time period between a turn-off time point of the control signal and an starting time point of the $N^{th}$ area pixel under a transition state in a next frame period.

25. A backlight module driving method, adapted to drive at least one backlight unit in a backlight module, wherein the backlight unit provides a surface light source to an $N^{th}$ area pixel of an LCD panel of an LCD, where N is a positive integer, the backlight module driving method comprising:

calculating a total time of the $N^{th}$ area pixel under a stable state in a frame period; and providing a control signal to drive the backlight unit when the $N^{th}$ area pixel is under the stable state in the frame period, wherein a frequency of the control signal is the same as a frame rate of the LCD, wherein a center position of a turn-on time of the control signal aligns with a center position of the total time of the $N^{th}$ area pixel under the stable state in the frame period, and the turn-on time of the control signal substantially does not extend into a transition state of the $N^{th}$ area pixel and an $(N+1)^{th}$ area pixel of the LCD panel, where the $(N+1)^{th}$ atrea pixel is close to the $N^{th}$ area pixel.

* * * * *